US006651634B2

(12) United States Patent
Sari et al.

(10) Patent No.: US 6,651,634 B2
(45) Date of Patent: Nov. 25, 2003

(54) EXHAUST GAS RECIRCULATION DEVICE WITH INTEGRAL DRIVE MODULE FOR AN INTERNAL COMBUSTION ENGINE

(75) Inventors: Osman Sari, Grevenbroich (DE); Helmut Blank, Bornheim (DE)

(73) Assignee: Pierburg GmbH, Neuss (DE)

( * ) Notice: Subject to any disclaimer, the term of this patent is extended or adjusted under 35 U.S.C. 154(b) by 178 days.

(21) Appl. No.: 10/037,580

(22) Filed: Jan. 4, 2002

(65) Prior Publication Data

US 2002/0092510 A1 Jul. 18, 2002

(30) Foreign Application Priority Data

Jan. 13, 2001 (DE) ..... 101 01 412

(51) Int. Cl.[7] ..... F02M 25/07
(52) U.S. Cl. ..... 123/568.23; 123/568.24
(58) Field of Search ..... 123/568.21, 568.23, 123/568.24; 251/129.11

(56) References Cited

U.S. PATENT DOCUMENTS 5,226,397 A * 7/1993 Zabeck et al. ..... 123/516
5,811,898 A * 9/1998 Everingham ..... 310/36
6,039,034 A * 3/2000 Field et al. ..... 123/568.23
6,164,248 A * 12/2000 Lehmann ..... 123/41.1

FOREIGN PATENT DOCUMENTS

DE 19941035 3/2000

* cited by examiner

*Primary Examiner*—Mahmoud Gimie
(74) *Attorney, Agent, or Firm*—Ladas and Parry

(57) ABSTRACT

Exhaust gas recirculation device for controlling recirculation of exhaust gases to the intake channels of an internal combustion engine. The device has a housing containing a rotary slide valve having a disk-shaped element attached to a rotatable drive shaft. The disk-shaped element controls flow of exhaust gas through openings in a stationary control element. A drive module is mounted on the housing for turning the rotary slide valve.

11 Claims, 2 Drawing Sheets

EXHAUST GAS RECIRCULATION DEVICE WITH INTEGRAL DRIVE MODULE FOR AN INTERNAL COMBUSTION ENGINE

BACKGROUND OF THE INVENTION

The invention relates to an exhaust gas recirculation device for an internal combustion engine in which the exhaust gas recirculation device is connected to an exhaust manifold of an exhaust system of the internal combustion engine to recirculate the exhaust gases to the air intake channels of the internal combustion engine. The exhaust gas recirculation device has a housing containing a valve including a disk-shaped element attached to a rotary drive shaft to control flow of the exhaust gases through openings in a control element to the air intake channels.

An exhaust gas recirculation device is disclosed in DE-A199 41,035 which cooperates directly with the air intake channels of the internal combustion engine. A connection element of an exhaust gas recirculation valve is adjusted by a drive shaft running along the air intake channels. This embodiment takes up a relatively large space and is sensitive to disruptions from external influences.

SUMMARY OF THE INVENTION

An object of the invention is to avoid these disadvantages and to provide an exhaust gas recirculation device, which is compact and is insensitive to disruptions from external influences.

This object is achieved according to the invention in that a drive module for a rotary slide valve is provided directly on the housing. In this way, a very compact structural arrangement of the exhaust gas recirculation device is obtained. This compact embodiment also reduces sensitivity to disruptions, since the drive module and the exhaust gas recirculation valve are no longer arranged separately in the engine space. The drive module is connected to a rotatable shaft of the disk-shaped element by means of a coupling constructed as a universal joint. It has been found advantageous if the openings in the control element have a defined geometrical shape, such as, circular, elliptical, polygonal and the like, so that a specific flow characteristic can be defined. Ceramic material has proven advantageous as the material for the control element. The control element is provided with scraping edges, which are in contact with the disk-shaped element in order to keep frictional forces between the disk-shaped element and the control element as small as possible. The disk-shaped element can be circular in cross-section for a four-cylinder internal combustion engine and provided with appropriate passage openings. Alternatively, it can be made cruciform in shape with the openings formed between adjacent legs of the cruciform shape. The disk-shaped element is urged against the control element by a spring, so that the sealing function of the exhaust gas recirculation valve is assured, and it is particularly advantageous for the disk-shaped element to be driven via the universal joint.

DETAILED DESCRIPTION

Figure 1:
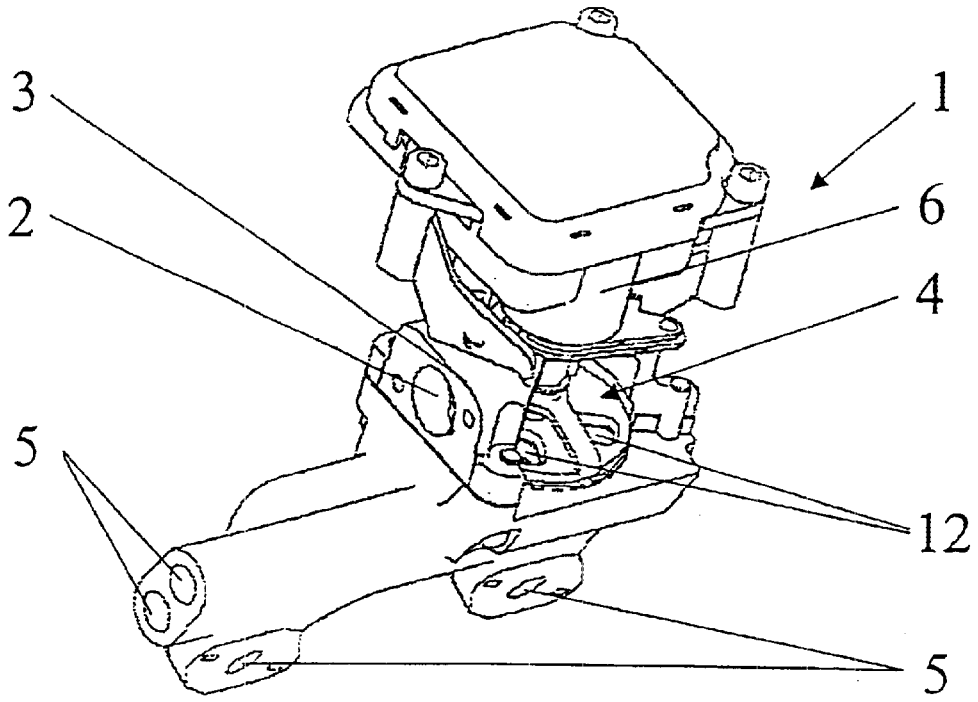
FIG. 1 is a perspective view of an exhaust gas recirculation device according to the invention, in which an outer wall o the housing has been omitted to show interior details of the device.

FIG. 1 shows in perspective view an exhaust gas recirculation device 1 according to the invention, in which a front wall of the housing 3 has been omitted to show interior details of the device. A part of an exhaust manifold 2 of an internal combustion engine is shown, which opens into the housing 3. The exhaust manifold 2 is connected via a rotary slide valve 4 with exhaust gas channels 5, which, in turn, are connected in conventional manner to air intake channels (not shown) of the internal combustion engine. In accordance with the invention, a drive module 6 for the rotary slide valve 4 is directly mounted on housing 3.

Figure 2:
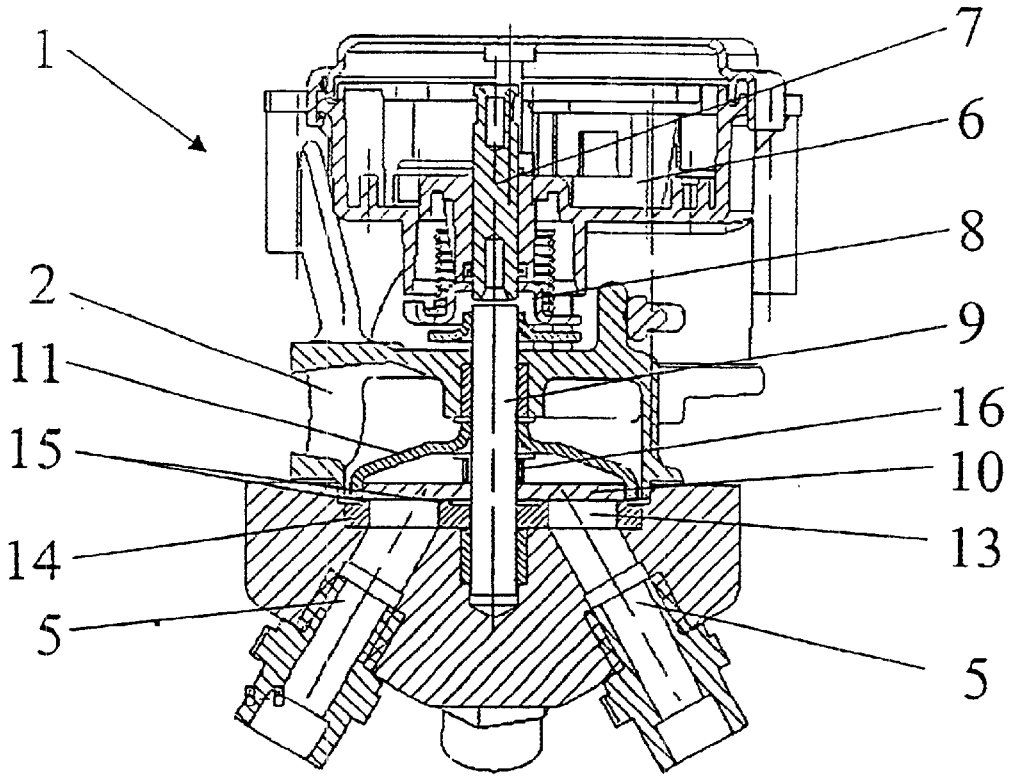
FIG. 2 is a longitudinal sectional view of the exhaust gas recirculation device in FIG. 1.

FIG. 2 shows the exhaust gas recirculation device 1 of FIG. 1 in longitudinal section. The drive module 6, which operates conventionally as an electrical drive module, drives a shaft 7, which is connected by a coupling 8, to a rotatable shaft 9 of a connection element 10. The connection element 10 is a disk-shaped element, which is circular in cross-section and is driven by a driver 11, the disk-shaped element 10 being suspended by a universal joint on driver 11. The disk-shaped element 10 has passage openings 12 (see FIG. 1) which are adapted to come into registry in varying amounts with openings 13 in a control element 14 in order to control exhaust gas recirculation. The openings 13 are connected to exhaust gas channels 5. Control element 14 is made of a ceramic material and it has scraping edges 15, which keep disk-shaped element 10 clean and enable substantially friction-free rotatable adjustment of the disk-shaped element by preventing accumulation of deposits of material thereon. The disk-shaped element 10 is urged against control element 14 by a spring 16, which is supported on rotary shaft 9, whereby sealing is assured when the rotary slide valve 4 is in the closed state.

The openings 13 in control element 14 may have a defined geometrical shape, for example, circular, elliptical, square, and the like, such that a specific flow characteristic can be defined for the recirculating exhaust gas passing therethrough.

Figure 3:
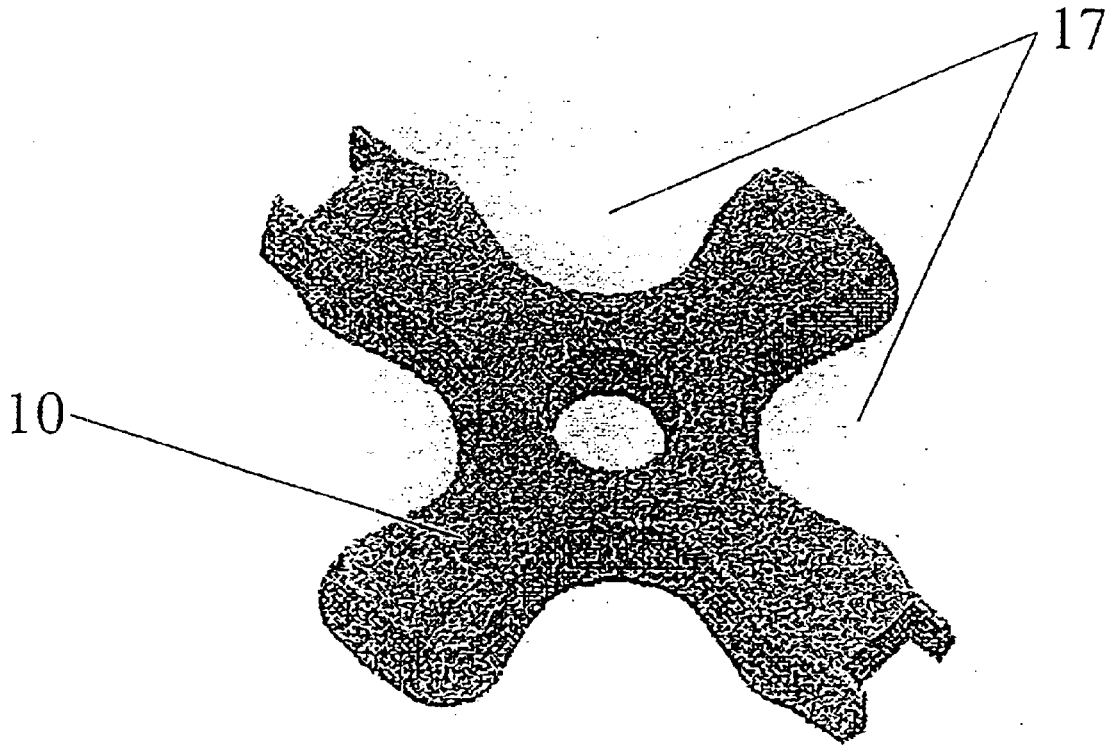
FIG. 3 illustrates an alternative embodiment of a disk-shaped connection element of the device.

FIG. 3 shows an alternative embodiment of the disk-shaped element 10, which is cruciform in shape. In this way, intermediate spaces 17 between adjacent legs of the cruciform shaped element can correspond with openings 13 in the control element.

Although the invention is disclosed with reference to particular embodiments thereof, it will become apparent to those skilled in the art that numerous modifications and variations can be made which will fall within the scope and spirit of the invention as defined by the attached claims.

What is claimed is:

1. An exhaust gas recirculation device for an internal combustion engine, said device comprising a housing having inlet openings for exhaust gases from the internal combustion engine and outlet channels for flow of the exhaust gases to air intake channels of the internal combustion engine, a control element having openings connected to the outlet channels, a rotary slide valve in said housing for controlling flow of the exhaust gases from said inlet openings to said opening in said control element and thereby to said outlet channels, said rotary slide valve comprising a disk-shaped element and a rotary drive shaft connected to said disk-shaped element, said disk-shaped element having openings which are adjustably brought into registry with the openings in said control element, and a drive module mounted on said housing for rotating said rotary drive shaft.

2. The device of claim 1, comprising a coupling connecting said drive module and said rotary drive shaft.

3. The device of claim 1, wherein said openings in said control element have a defined geometrical shape to provide a particular air flow characteristic for the exhaust gas passing therethrough.

4. The device of claim 1, wherein said openings in said control element are circular, elliptical or polygonal in shape.

5. The device of claim 1, wherein said control element is made of ceramic.

6. The device of claim 1, wherein said control element has scraping edges in contact with said disk-shaped element of the rotary slide valve.

7. The device of claim 1, wherein said disk-shaped element of the rotary slide valve has a circular shape with its openings provided therein.

8. The device of claim 1, wherein said disk-shaped element of the rotary slide valve has a cruciform shape with open spaces forming said openings in the disk-shaped element.

9. The device of claim 1, comprising a spring urging said disk-shaped element of the rotary slide valve against said control element.

10. The device of claim 1, wherein said rotary slide valve further comprising a driver connected to said drive shaft, said driver being connected to said disk-shaped element by a universal joint.

11. The device of claim 1, wherein said module is driven electrically.

* * * * *